United States Patent [19]

Donato et al.

[11] 4,082,395

[45] Apr. 4, 1978

[54] LIGHT TRACK DEVICE WITH CONNECTOR MODULE

[75] Inventors: Anthony C. Donato, Westfield; Neil Russo, Jersey City, both of N.J.

[73] Assignee: Lightolier Incorporated, Jersey City, N.J.

[21] Appl. No.: 770,388

[22] Filed: Feb. 22, 1977

[51] Int. Cl.[2] ..... H01R 9/12

[52] U.S. Cl. ..... 339/21 R; 339/22 B; 339/95 D

[58] Field of Search ..... 339/21 R, 22 R, 22 B, 339/95 D, 258 C

[56] References Cited

U.S. PATENT DOCUMENTS

| | | | |
|---|---|---|---|
| 3,295,093 | 12/1966 | Neumann | 339/21 R |
| 3,596,226 | 7/1971 | Meltzer | 339/22 B |

FOREIGN PATENT DOCUMENTS

| | | | |
|---|---|---|---|
| 562,518 | 5/1975 | Switzerland | 339/95 D |

*Primary Examiner*—Mark S. Bicks

*Attorney, Agent, or Firm*—Arthur B. Colvin

[57] ABSTRACT

The present invention is directed to a light track device of the type which mechanically and electrically supports fixtures such as spotlights or the like at any selected position along the length thereof, the device being characterized by an improved attachment module facilitating the formation of electrical connections between the conduits in the light track and the mains conduits. The module incorporates clamps or connector fixtures within which the mains conduits may be placed, secure mechanical and electrical interlock between the mains conduits and the fixtures being effected by the exertion of a lateral force against the mains conduits.

6 Claims, 8 Drawing Figures

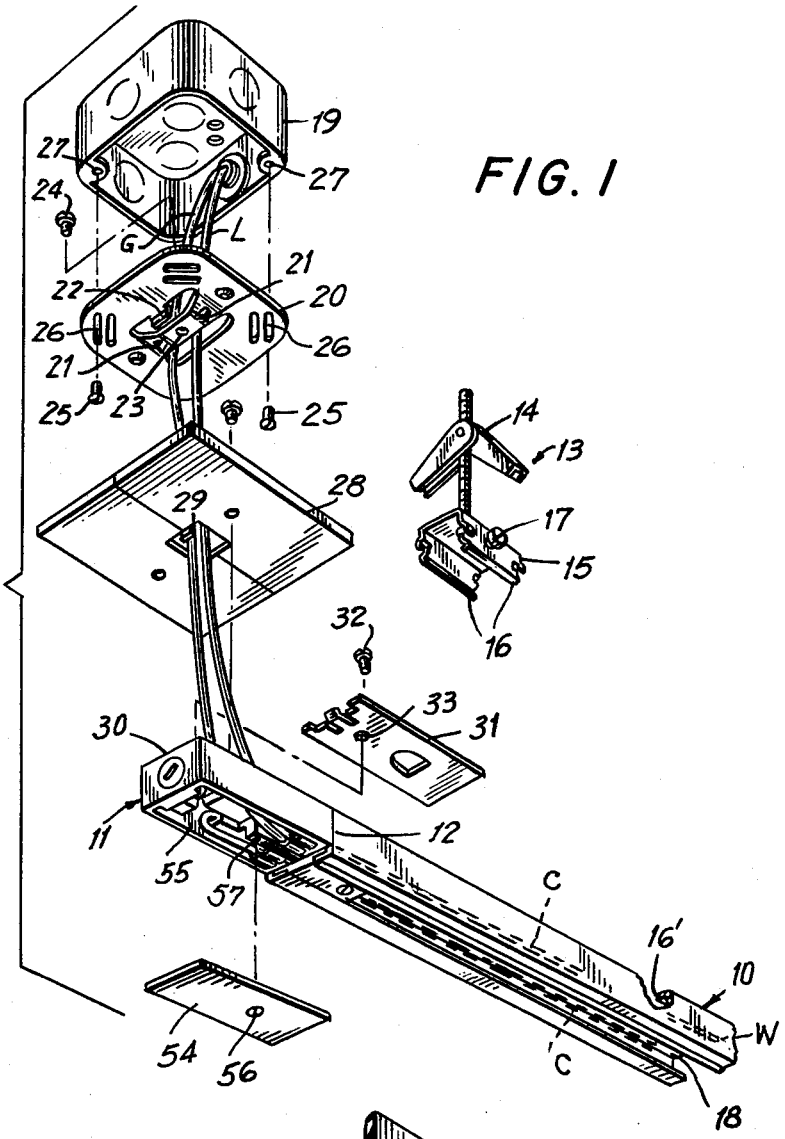
FIG. 1
FIG. 2
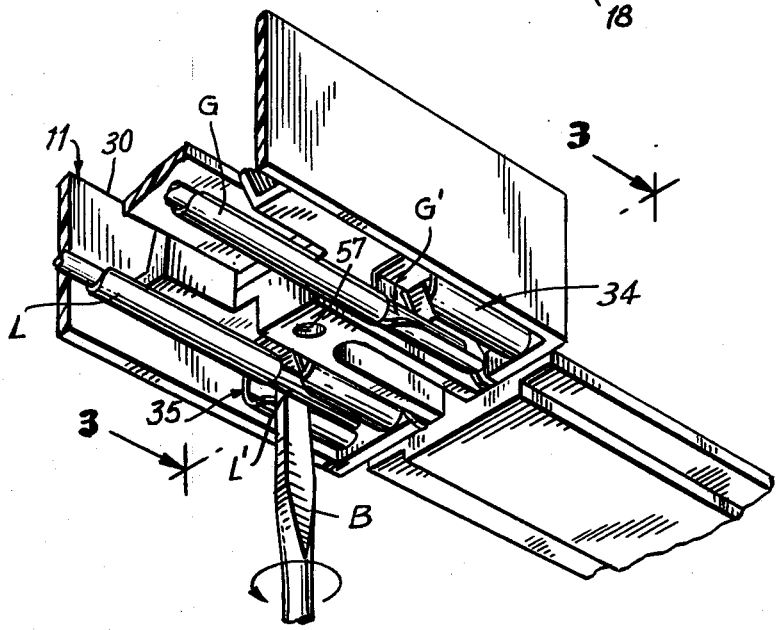

LIGHT TRACK DEVICE WITH CONNECTOR MODULE

BACKGROUND OF THE INVENTION

1. Field of the Invention

The present invention is in the field of electrical lighting devices, and more particularly is directed to a lighting track device having an improved connector module, facilitating the formation of electrical connections between the track and a mains conduit.

2. The Prior Art

It is known to provide a lighting track consisting essentially of an elongate metallic or plastic extrusion having disposed therein a pair of conductor members. Light tracks of the type described are typically mounted to a wall or ceiling and include a downwardly open chamber within which electrical contacts are supported in electrically isolated relation. A variety of appliances, such as spotlights, etc. may be engaged mechanically and electrically by inserting a fixture upwardly through the mouth of the open chamber of the track, the fixtures, after insertion, being caused to contact the conduits and grip the channel.

It is a desirable attribute of track assemblies of the type described that the same be unobtrusive in appearance since they are generally exposed on the ceiling. Consonant with the desire for presenting an inconspicuous appearance, the tracks are formed of the smallest size possible.

Heretofore the connection of mains conductors to the light track has involved passing lead wires into the interior of a module or extension of the track, bending the lead wires about connector posts which are threadedly engaged in a terminal block, and tightening the posts to clamp the lead between the block and a head of the post. As will be readily recognized by those familiar with electrical installations, the mains conduits are typically insulated, solid copper wires of 12 gauge or thicker, which wires are stiff and difficult to manipulate. The difficulty in effecting a connection is compounded by the fact that the terminal block portion, due to the desirably small dimensions of the track assembly, provides little room for performing the necessary operations, resulting, in many instances, in an improper connection between the mains and track.

SUMMARY

The present invention may be summarized as directed to an improved light track assembly and connector module therefor having means for readily effecting connection between the conduits of the light track and mains conduits. More particularly, the connector module includes a downwardly open compartment within which is located a pair of clamp fixtures, each having the general form of an inverted U, the legs of such fixtures being inclined upwardly toward the base. Connection of a mains conduit to the clamps is effected by forcing the conduit upwardly into the space between the legs of the U and thereafter exerting a lateral force on the inserted conduit, whereby the conduit is clamped and electrically connected between the fixture and a spring tab or tabs depending from the base thereof.

The operation above described requires no bending of the conductor components of the mains lead, whereby the installation of the light track is greatly facilitated.

Accordingly, it is an object of the invention to provide an improved light track assembly particularly characterized by its ability to be readily connected to the electrical mains.

A further object of the invention is the provision of a device of the type described, and of an improved module therefore, wherein connection between the mains lead and the connector module may be made by merely laying the stripped portion of the lead into a receiver mouth, inserting a screw driver into the mouth, and rotating the screw driver, whereby there is developed a lateral force sufficient tightly and permanently to secure the lead to a terminal within the module.

Still a further object of the invention is the provision of a light track assembly and module of the type described which eliminates the necessity for bending the mains leads about terminal posts and clamping the leads by threading the posts into terminal blocks.

To attain these objects and such further objects as may appear herein or be hereinafter pointed out, reference is made to the accompanying drawings, forming a part hereof, in which:

FIG. 1 is an exploded perspective view of a light track assembly in accordance with the invention, the assembly being shown in conjunction with a typical electrical supply fixture customarily associated therewith;

FIG. 2 is a magnified perspective view of a connector module in accordance with the invention;

Figure 3:
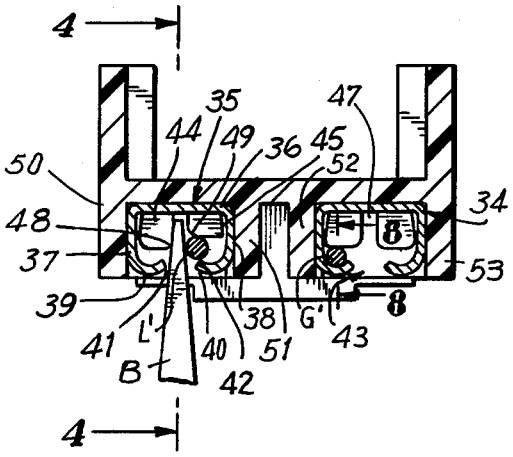
FIG. 3 is a vertical section taken on the line 3—3 of FIG. 2.

As conducive to an understanding of the present invention, there is shown in FIG. 1 a light track assembly 10 having a connector module 11 secured to one end 12 of the track assembly. The track 10 is held to a ceiling or wall structure by a series of mounting clips 13, known per se, the clips including a conventional toggle bolt 14 at one end and a support clip 15 at the other or lower end. The support clip is adapted to fit within a longitudinally extended, upwardly facing chamber of the track 10, the clip including lips 16 which extend laterally outwardly under complemental, inwardly directed lips 16' formed on opposite sides of the extrusion forming the track 10. A locking screw 17 on the assembly 13 fixes the clip against longitudinal movement relative to the track 10 at a position along the track in registry with the location at which the toggle 14 extends through an aperture in the ceiling.

As is conventional, the track 10 includes, in the interior thereof, longitudinally extending energizing conduits C, the conduits being spaced apart and maintained within a non-conductive insert (not shown) housed in the downwardly open access channel 18, whereby spotlights or like fixtures equipped with appropriate tapping mechanisms may be mechanically and electrically affixed at any of a variety of locations along the track 10.

The interior structure of the light track per se forms no part of the instant invention, suitable and exemplary tracks and tapping fixtures being disclosed in one or more of U.S. Letters Pat. No. 3246,074; 3286,052; 3295,093; and 3496,518.

Electrical connection between the conduits C and the mains lines L and G is effected within the connector module 11 which is mounted within the end 12 of the track 10.

As illustrated in the above referenced patents, the module 11 includes connector tabs (not shown) which enter into the channel 10 and engage the conduits C to energize the conduits.

The mains lines G and L extending from outlet box 19 are connected to the light track 10 within the module 11. Optionally, the track 10 may itself be mechanically supported from the outlet box 19. For this purpose, cover plate 20 of the box is provided with laterally extending fingers 21 and is adapted to fit under the inturned lips 16' of the track. The cover plate 20 may include a depending tee 22, likewise sized slidably to fit within the upper compartment of the channel under the lips 16'. A screw member 24 may be extended through threaded aperture 23 of plate 20 to prevent longitudinal relative movement of the track by advancing the screw until it bears against the transverse web W of the track.

The cover plate 20, in the usual manner, is held to the outlet box as by machine screws 25 which extend through complemental slots 26 in the cover plate, the machine screws being anchored in threaded apertures 27 of the outlet 19. A decorative canopy 28, which may be formed of two half sections, may be mounted by screws (not shown) in appropriately positioned apertures in the cover plate 20. The canopy 28 preferably includes a through-going aperture 29, providing clearance for the track supporting components above described.

From the above description it will be appreciated that the outlet 19 may be disposed at virtually any position along the length of the track 10 and may function to aid in supporting the track.

The mains leads L and G are dressed within the upper compartment of the track 10 in the area above the web W and passed downwardly through the upper open mouth portion 30 of the module. An upper cover plate 31 is mounted in closing position of the mouth portion 30, as by machine screw 32 passing through aperture 33 in the cover plate and threaded into a complemental bore (not shown) of the module.

The principal advance of the present invention resides in the clamping mechanism by which the stripped end portions L' and G' of the leads L and G are electrically and mechanically connected to the module.

The module carries a pair of connector clamps 34 and 35 adapted to receive the pre-stripped lead portions G' and L', respectively. Since the connector clamps 34, 35 are identical, a description of one will suffice.

The clamps, as best seen in FIGS. 2 and 3, are generally in the form of inverted U's, including a horizontally directed base portion 36, depending side legs 37, 38, the end portions 39, 40 of the legs being inturned so as to define ledges overlying a portion of the base 36.

Figure 4:
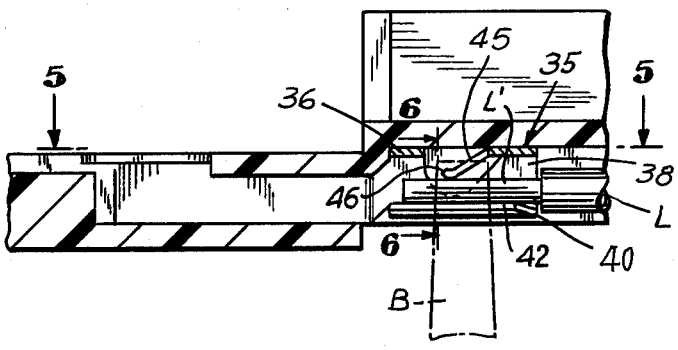
FIG. 4 is a section taken on the line 4—4 of FIG. 3.
Figure 5:
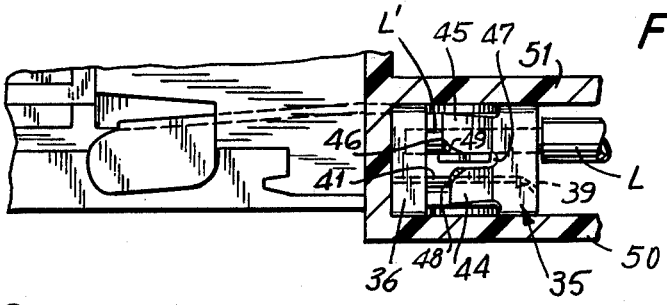
FIG. 5 is a horizontal section taken on the line 5—5 of FIG. 4.

The legs, adjacent the ends 39, 40 are inclined at a non-reentrant angle toward the base 36, the distal edges 41, 42 being spaced apart and defining an entry or wire receiver slot 43 therebetween. A pair of retainer spring tabs 44, 45 are formed integrally of the base 36. The tabs, as best seen in FIG. 4, are inclined from the base toward the ledge portions 39, 40, the tabs preferably terminating in sharpened, downwardly facing edges 46.

The fixtures 34, 35 are formed of a resilient, highly conductive metal, preferably a beryllium-copper alloy, which provides the necessary low electrical resistance together with the desired springiness.

The tabs 44, 45 are spaced apart by a slot 47 in registry with the receiver slot 43. Additionally, the tabs preferably include camming portions 48, 49 inclined toward receiver slot 43 for purposes which will appear hereinafter.

The fixtures 34, 35 are inset within the module 11, the module being formed of insulated plastic material, the interfit between the module 11 and fixtures 34, 35 being such that the side walls or legs 37, 38 of the clamps are prevented from spreading by backing portions or walls 50, 51 of the module. In similar fashion, the legs of the fixtures 34 are reinforced by walls 52, 53 of the module.

The operation of connecting the mains leads L and G to the module involves merely stripping the leads, as shown at L' and G', and bending the leads so that the same lie essentially parallel to the track 10. Strip portion L', for instance, is next inserted into the receiver slot 43. Thereafter a screw driver or like instrument is inserted through the receiver slot, as shown in FIG. 3. It is immaterial to which side of the lead the screw driver blade B passes.

With the parts positioned as shown in FIG. 3, the screw driver blade B is rotated about an axis normal to the length of the track, whereby a lateral force of substantial nature is exerted against the lead L', the force being augmented by the fact that the edge of the screw driver blade not engaging the lead reacts against inturned portion 41 of the opposite leg e.g. the leg 37. The lateral force noted, in part by virtue of the cam portion 49 of the tab, will cause the tab to be depressed toward the base 36, whereby the wire may pass underneath the tab and will be clamped between the tab and the inturned portion 39 or 40 at the end of the respective leg. (Compare partially seated, lefthandmost position of FIG. 3 with the fully seated position of the lead G' of FIG. 4).

Figure 6:
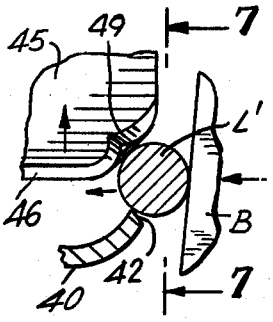
FIG. 6 is a fragmentary section taken on the line 6—6 of FIG. 4.
Figure 7:
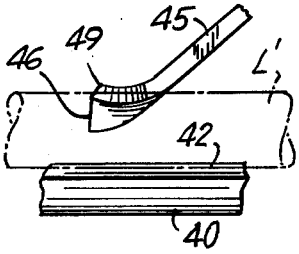
FIG. 7 is a section taken on the line 7—7 of FIG. 6.
Figure 8:
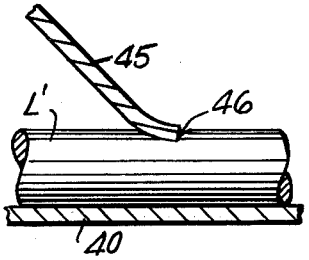
FIG. 8 is a section taken on the line 8—8 of FIG. 3.

The camming influence resulting from the application of lateral force is best appreciated from an inspection of FIGS. 6 and 7 wherein the parts are shown in partially seated position, final positioning of the tab, lead and inturned ledge being shown in FIG. 8.

After the lead has passed to a position in registry with the inturned portion 39 or 40, it will be seen that the leads are firmly gripped and are not subject to return movement toward the receiver slot unless a reverse biasing force is intentionally applied to the lead.

After seating of a first lead within one of the fixtures 34 or 35, a second lead may, if necessary, be introduced into the receiver slot and pried into position in the manner hereinabove set forth in the space not occupied by the first lead.

From a consideration of the above description, it will be readily recognized that the operation of securing leads to the module in accordance with the present invention provides a simple and rapid mode of completing the circuit to the light track, avoiding bending of the contact portion of the leads, wrapping of the leads about terminal posts or screws, tightening of screws, etc.

After the mains leads are clamped, a finishing plate 54 of insulating material may be secured in position in covering relation of the lower mouth portion 55 of the module, the plate being retained in the noted disposition by a retainer screw 56 threadedly connected to a complementally located aperture 57 in the module.

The fixture of the present invention is especially adapted to effecting connections to a light track or like mechanism wherein space is at a premium. The effectiveness of the electrical connection has been experimentally determinated to be substantially equal to the conventional but more difficultly effected clamp/screw arrangement. The connection is found to be essentially unaffected by vibratory movements.

It will be apparent to those skilled in the art that variations may be made in the disclosed apparatus without departing from the spirit of the invention and, accordingly, the invention is to be broadly construed within the scope of the appended claims.

Having thus described the invention and illustrated its use, what is claimed as new and is desired to be secured by Letters Patent is:

1. An electrical connector fixture adapted electrically to connect a light track with an electrical mains supply comprising an attachment module including a downwardly open mouth portion, first and second mains connector clamps mounted in said module in mutually electrically isolated relation and coupled, respectively, with the conductors of said light track, each said clamp being formed of resilient conductive material and comprising a base, a spaced pair of legs extending from each base, each said leg terminating in an inturned ledge portion overlying a portion of its base, said ledge portions terminating in distal edges spaced to define downwardly open elongate entry slots therebetween, said distal edges being inclined toward said bases, a spring retainer tab member formed integrally with each base, said tab members being directed toward said ledges and terminating in retainer edges spaced from said ledges a distance less than the thickness of a said mains lead, and cam means formed on said tab members and inclined in the direction of said entry and toward said base slots, to deflect said tab members toward said bases responsive to lateral forces exerted against said cam means by mains leads, whereby said leads are resiliently clamped between said ledges and tab members.

2. A fixture in accordance with claim 1 wherein each tab member comprises a spaced pair of tab portions, the space between said portions being in registry with its slot.

3. A light track device in accordance with claim 2 wherein said module includes stiffener wall means engaging said legs for limiting lateral deflection thereof.

4. In combination with a light track device including an elongate channel having an upper section adapted to be disposed against a mounting support surface and a lower section, said lower section including a longitudinally extending opening providing access to a pair of longitudinally extending electrical conduits disposed therein, the improvement which comprises a mains supply attachment module connected to said channel, said attachment module including a downwardly open mouth portion, first and second mains connector fixtures mounted in said module in mutually insulated relation, each said connector fixture being in electrical contact with one of said conduits, said connector fixtures being adapted electrically and mechanically to clamp a mains lead therein, said fixtures comprising a resilient conductive metal component in the general configuration of an inverted U elongated in the direction of said track and including a central branch and a spaced pair of legs, a ledge portion formed at the end of each of said legs, said ledges being in mutually facing opposed relation and terminating in distal edges inclined toward said base and defining therebetween a downwardly open entry slot elongated in the direction of said track, a retainer spring tab member formed integrally with said branch, said tab member extending toward said ledge portions, the lowermost edge of said tab member terminating in spaced relation to said ledge portions, the spacing of said lowermost edge from said ledge portions being less than the thickness of a said mains lead, whereby a mains lead aligned with said track may be upwardly introduced into the interior of said U configuration through said entry slot and subjected to a lateral force in the direction of either said leg will be resiliently clamped between a said ledge and tab member.

5. A light track device in accordance with claim 4 wherein said tab member comprises a spaced pair of tab portions, the space between said tab portions being in registry with said slot, said tab portions including cam means inclined laterally relative to said entry slot and toward said base.

6. A light track device in accordance with claim 5 wherein said module includes stiffener wall means engaging said legs for limiting outward lateral deflection thereof.

* * * * *